United States Patent [19]

Beaudoin

[11] 4,449,494

[45] May 22, 1984

[54] INTERNAL COMBUSTION ENGINE

[75] Inventor: Normand Beaudoin, Le Gardeur, Canada

[73] Assignee: Compagnie du Moteur Energitique C.M.E. Inc., Quebec, Canada

[21] Appl. No.: 464,144

[22] Filed: Feb. 7, 1983

Related U.S. Application Data

[63] Continuation-in-part of Ser. No. 436,823, Oct. 26, 1982, abandoned.

[30] Foreign Application Priority Data

Oct. 29, 1981 [CA] Canada ..... 389266

[51] Int. Cl.[3] ..... F02B 75/32

[52] U.S. Cl. ..... 123/52 A; 123/197 AC; 123/56 C

[58] Field of Search ..... 123/52 A, 54, 48 B, 123/56 C, 78 F, 197

[56] References Cited

U.S. PATENT DOCUMENTS

| | | | |
|---|---|---|---|
| 1,505,856 | 8/1924 | Briggs | 123/74 A |
| 1,687,425 | 10/1928 | Briggs | 123/197 AC |
| 2,229,545 | 1/1941 | Beckstrom | 123/56 C |
| 2,909,163 | 10/1959 | Biermann | 123/54 R |

*Primary Examiner*—Craig R. Feinberg

*Attorney, Agent, or Firm*—Cushman, Darby & Cushman

[57] ABSTRACT

An internal combustion engine wherein the rod connecting the piston to the crankshaft has an enlarged portion defining a track which a crankshaft element cooperatingly engages; the track is topologically shaped so that the effect exerted by the crankshaft element on the connecting rod is reduced and/or cancelled for a given travel distance of the crankshaft element in the track.

5 Claims, 8 Drawing Figures

10
12
14
16
18
20
22
24
26
28
30
32
34
36
38
40
41
42
43
44
46

INTERNAL COMBUSTION ENGINE

CROSS-REFERENCE TO RELATED APPLICATION

This application is a continuation-in-part of application Ser. No. 436,823 10/26/82 now abandoned.

FIELD OF THE INVENTION

The present invention relates broadly to internal combustion engines such as gas, diesel, rotary, orbital engines, or the like. More particularly, the present invention relates to improvements in the construction of internal combustion engines.

BACKGROUND OF THE INVENTION

The ideal time for explosion in conventional four-stroke engines is during maximum compression of the combustible gas. However, this time, although ideal for explosion, is not so as far as the position of the crankshaft is concerned. Indeed, when compression is maximum, that part of the crankshaft attached to the connecting rod is at its highest point of displacement. An important part of the force resulting from the explosion which causes the piston to move in a downward rectilinear direction, is lost due to friction. Consequently, it is only a lesser part of this force which gives the crankshaft its circular motion. Hence, as far as the crankshaft is concerned, its ideal position during explosion would be when it extends perpendicular to the connecting rod. To provide this feature in a conventional internal combustion engine would not be beneficial since what would be gained with respect to the crankshaft would be loss in the power transmitted: indeed, when the crankshaft is in a perpendicular position with respect to the piston, the latter has already travelled a certain distance and has lost an important portion of its motive force.

OBJECTS AND STATEMENT OF THE INVENTION

It is therefore an object of the present invention to provide, in an internal combustion engine, a novel construction for some of the components found in the engine to thereby achieve a more effective combination of motive force and crankshaft rotation. This is achieved by devising a connecting rod which allows to maximize engine efficiency while permitting a more favorable explosion time.

The present invention therefore relates to an improvement for an internal combustion engine having a block and a piston reciprocally displaceable therein along an axis; the improvement concerns a connecting rod which has one end attached to the piston and its opposite end defining an enlarged portion displaying a track therein; the track extends laterally of the displacement axis of the piston; the improvement further comprises, to the crankshaft rotatably mounted in the block, means cooperatingly engaging the track and being displaceable therein. An important feature of the present invention is that the track is so shaped as to reduce and/or cancel the effect created by the crankshaft means on the connecting rod for a given travel distance of these means in the track.

Hence, this is contrary to conventional systems in which the crankshaft is continually exerting a force component on the connecting rod except for an extremely short time when the piston changes direction in its displacement.

Another feature of the present invention is the maximalisation of the energy output of the explosion. In conventional engines, the actual power is the result of the difference between the power produced by the explosion minus the power force which is required for a new compression of the combustible. The new compression of the piston is subjected directly to the action of another piston in its exploding phase, since both are directly linked to the crankshaft. The energy engine reduces greatly the energy necessary for a new compression and maximizes the power resulting from the combustion of energy.

Hence, in another form of the invention, there are provided a master crankshaft and a plurality of individual crankshafts for each piston and rod. In this embodiment, a series of slotted levers connect the individual crankshafts to the master crankshaft. The displacement of each slotted lever is biased by the presence of pivot means which extends through its slot.

The levers have a dynamic effect in that their movement is directly caused by that of the two systems of crankshafts. Since they connect and lever at the same time, they move not only in relation to the crankshafts, but also in relation to the pivot means which is situated approximately at equal distance from the central axes of these crankshafts.

The scope of applicability of the present invention will become apparent from the detailed description given hereinafter; it should be understood, however, that this description, while indicating preferred embodiments of the invention, is given by way of illustration only since various changes and modifications within the spirit and scope of the invention will become apparent to those skilled in the art.

IN THE DRAWINGS

DESCRIPTION OF PREFERRED EMBODIMENTS

Figures 1, 2, 3:
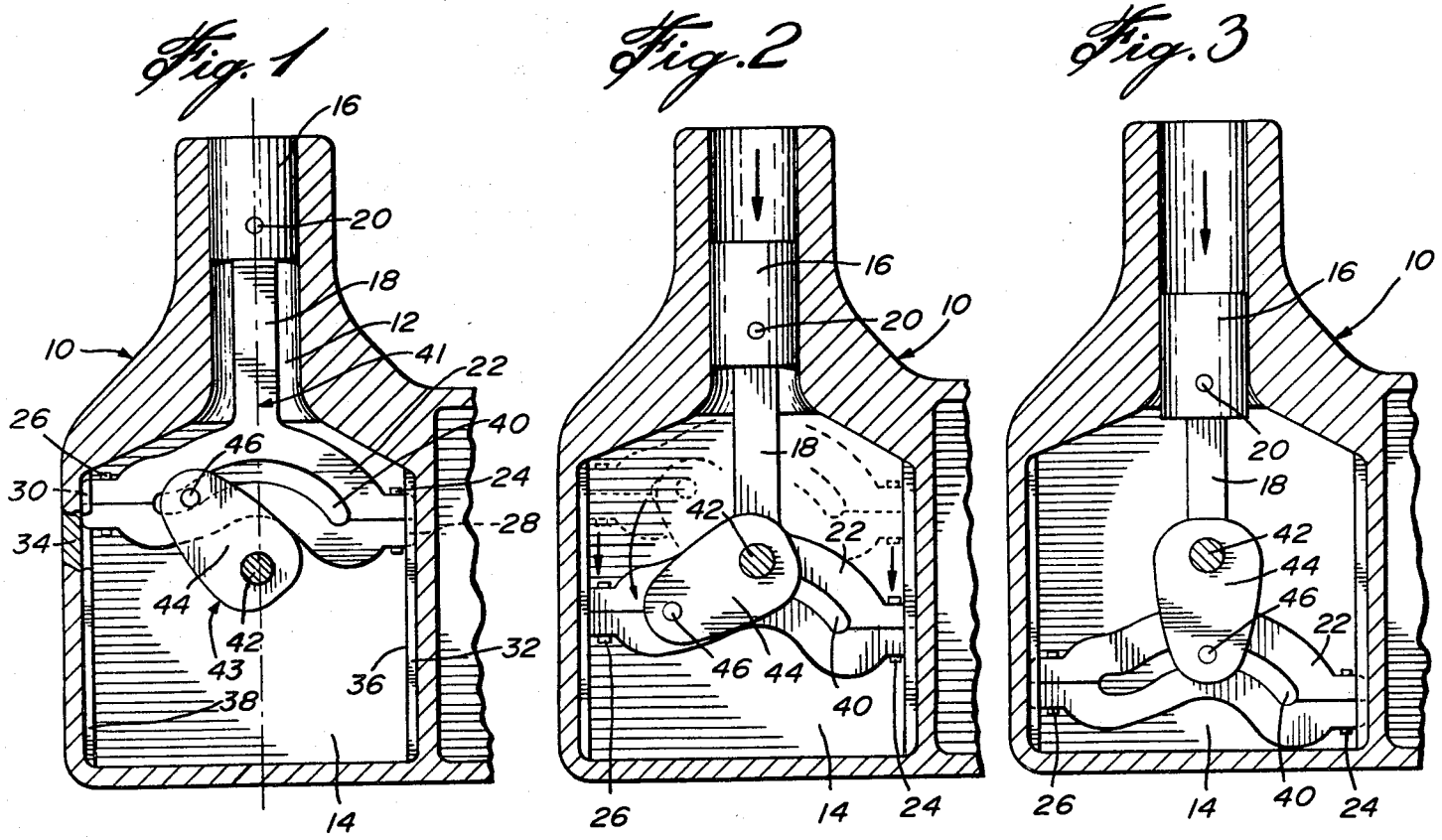
FIG. 1 shows a cross-sectional elevation of part of an internal combustion engine made in accordance with the present invention, showing the piston staying in its highest position.
FIGS. 2, 3 and 4 are cross-sectional elevations, similar to that of FIG. 1, illustrating various positions of the components of the present invention in successive steps.
Figure 4:
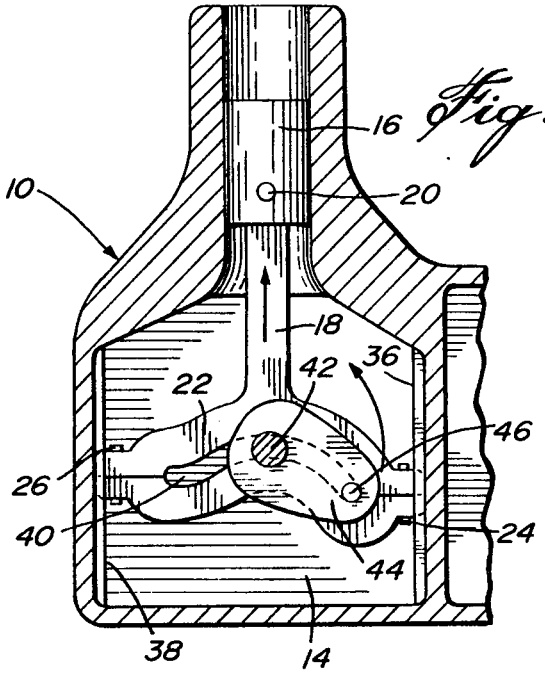

Referring to FIG. 1, there is shown part of an internal combustion engine comprising a block, generally denoted 10, having an upper cylindrical chamber 12 and a lower enlarged chamber 14. A piston 16 is mounted for reciprocating movement in the upper chamber 12. A connecting rod 18 has its upper end fixedly attached at 20 to the piston 16. The connecting rod has an enlarged lower portion 22 (which may be formed of two halves 24 and 26 bolted together) which has its opposite extremeties 28 and 30 slidably and guidingly received in opposite side grooves 32 and 34 formed in the sidewalls 36 and 38 of chamber 14.

An important feature of the present invention is the provision of a track or slot 40 which is formed in the enlarged portion 22 of the connecting rod. This track extends laterally of the imaginary displacement axis 41 of the piston.

Also mounted in the engine block is a crankshaft, generally denoted 43, mounted for rotation about an axis 42 and having a crank portion 44 and crank pin 46. Slot 40 has a width slightly greater than the dimension of crank pin 46 so as to be received therein. This slot includes an arc-shaped central portion which serves to reduce and/or cancel the vertical effect which is exerted by the crankshaft on the connecting rod for a given distance of travel of the crank pin in the pin.

With reference to FIGS. 1–4, the crank pin, when in its uppermost position and lowermost position, is situated at the center of track 40. In its opposite lateral positions, the crank pin is located at the corresponding opposite extremities of the track.

It must be said that, due to the slotted connecting rod, the piston speed is no longer continusously and directly dependent solely up on that of the crankshaft: it now becomes the resultant of the crankshaft movement and of the travel of the crank pin in the shaped track. Therefore, the configuration given to the track is such that it modifies the speed of the piston: not only does it accelerate or decelerate this speed with respect to the crankshaft movement but, also, it either stops it completely or doubles it.

From this, it can be seen that if a segment of the track is given a curvature similar to the motion of the crank pin in its upper trajectory, the motion of the piston will be cancelled during the time when the sliding of the crank pin reproduces the same trajectory relative to the track.

Inversely, the motion of the piston will be multiplied when the crank pin follows the same trajectory, but in its lower phase.

Such cancellation of motion keeps the piston in its position of compression until the position of the crank pin is more favorable for explosion; the cancellation of motion allows for the selection of an ideal time which combines the two systems in a simultaneous optimal position for the explosion of the combustible. There results an increase of energy output of the engine.

As for the multiplication of the speed of the piston by the inverted motion of the crank pin along the track during its lower trajectory, it occurs when the compression is at its minimum and, consequently, it increases also the output of the engine.

Finally, the shape of the track which varies normally between the arc produced by the motion of the crank pin and the straight line, induces a greater regularity in the upward motion of the piston. In fact, due to its shape and because the connecting rod is directly linked to the crank pin, the piston slows down when the lateral motion of the crank pin is more important than its vertical motion. The curvature of the track can be so designed as to acquire the adequate speed of the piston independently of the speed of the crank pin.

Figure 5:
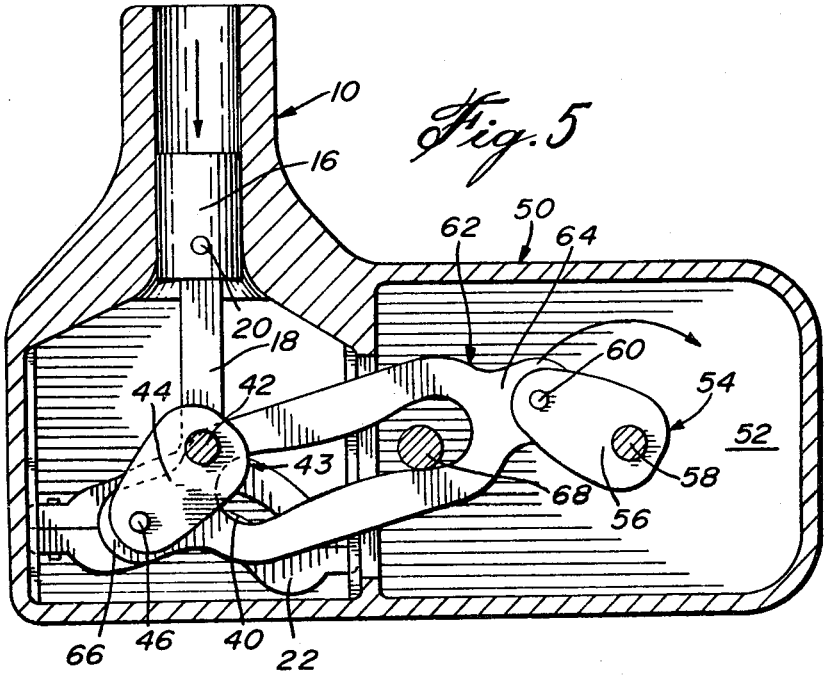
FIGS. 5 and 6 are cross-sectional elevations illustrating two successive positions of another embodiment of the present invention in which the crankshaft is connected to a master crankshaft through a slotted lever.
Figure 6:
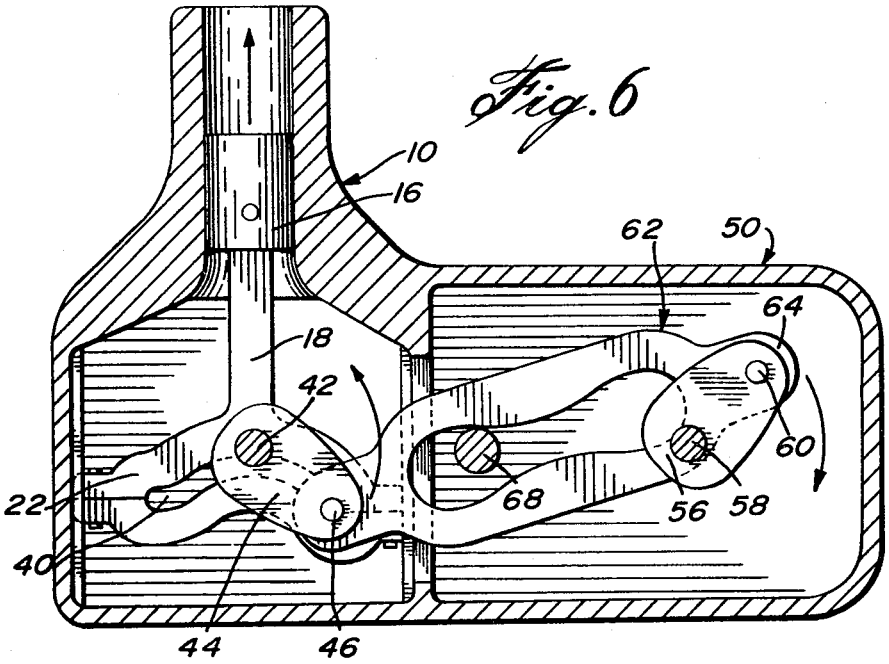

Referring to FIGS. 5 and 6, there is shown a lever system which connects two types of crankshafts and which results in an increase of output.

Parts of the engine which are identical to parts shown in FIGS. 1 to 4 will bear identical reference numbers. In this embodiment, the engine block 10 has an extension 50 defining a closed chamber 52 in which is rotatably mounted a second crankshaft, generally denoted 54. A crank 56 of this crankshaft is mounted for rotation about the crankshaft axis 58 and includes a pin 60 pivotally connected to a slotted lever 62 at one end 64 thereof. The opposite end 66 of the lever is pivotally connected to pin 46 of the crank 44 described above. Hence, lever 62 interconnects the two crankshafts 43 and 54. The slot of lever 62 has an 8-shape which is traversed by a pin 68 fixed to the engine block 50. This pin biases the trajectory of the lever, the opposite ends of which are rotatable about respective parallel axes 46 and 60.

The arrangement of lever 62, pin 68 and cranks 44, 56 is such that contrary vertical motions are obtained with, however, similar lateral motions.

Figure 7:
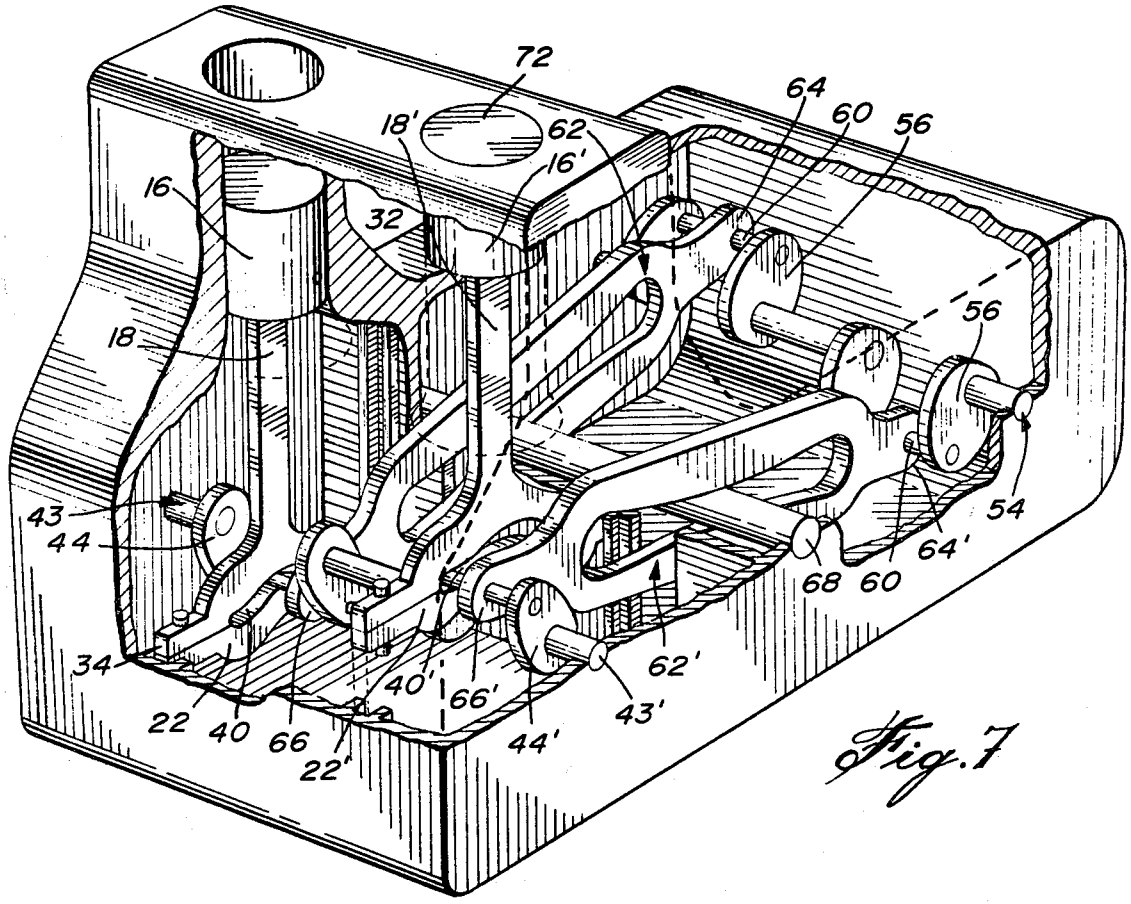
FIG. 7 is a perspective view illustrating another embodiment of the present invention where two individual crankshafts are connected to a master crankshaft.

FIG. 7 is a three-dimensional representation of an engine having a pair of auxiliary or individual crankshafts 43, 43' and a master crankshaft 54. Crankshaft 43' is part of a system identical in construction to the system associated with crankshaft 43; therefore, a description will not be repeated for the construction and operation of the second system and all parts thereof will bear a reference numeral identical to those of the first system with the addition of a prime mark.

Both systems are connected to the master crankshaft 54. The first system is connected via lever 62 while the second system is connected via lever 62'. However, both levers 62, 62' are traversed by a common pivot pin 68 mounted to the engine block. The auxiliary crankshafts 43, 43' are relatively independent from one another. In this example, they move counter clockwise as indicated by arrow 70. Point P represents the ideal time for explosion to take place, i.e. when compression is near its maximum at 72 and when crank 44' is inclined by an angle 74. This is the position when the piston is at its uppermost position. The other piston is shown in its compression phase. The levers have a dynamic effect in that their movement is directly caused by that of the two systems of crankshafts. Since they connect and lever at the same time, they move not only in relation to the crankshafts, but also in relation to the pivot pin which is situated at equal distance from the central axes of these crankshafts. When the engine is operating, the levers set the pistons in their most dynamic position relative to the master crankshaft at the time of explosion and, inversely, set the master crankshaft in its most dynamic position relative to the pistons at the time of compression.

During explosion, each lever is in such a position that the pivot pin is momentarely at one end of the lever slot closest to the master crankshaft. This results in the auxiliary crankshaft to move the master crankshaft in a very economical way since the length of that part of the lever which is situated between the connection of the auxiliary crankshaft to the lever and the pivot pin is greater than the length between the connection of the lever to the master crankshaft and the pivot pin.

Inversely, the action of the crankshafts allows the lever to move laterally relative to the pivot pin and to thereby generate opposing forces.

During compression, it is the distance of that part of the lever situated between the pivot pin and the connection to the master crankshaft which is greater than the distance between the connection to the auxiliary crankshaft and the pivot pin. The action of the master crankshaft on the auxiliary crankshaft, and consequently on compression, is thus made easier.

The auxiliary crankshafts are not directly joined together. On the contrary, one crankshaft receives or gives an impulse to the other through the assistance of the master crankshaft and the double action of the levers.

Therefore, the sliding action of the lever enables to take advantage in a more dynamic manner of the leverage effect to increase the force obtained by explosion and to reduce loss resulting from compression.

Figure 8:
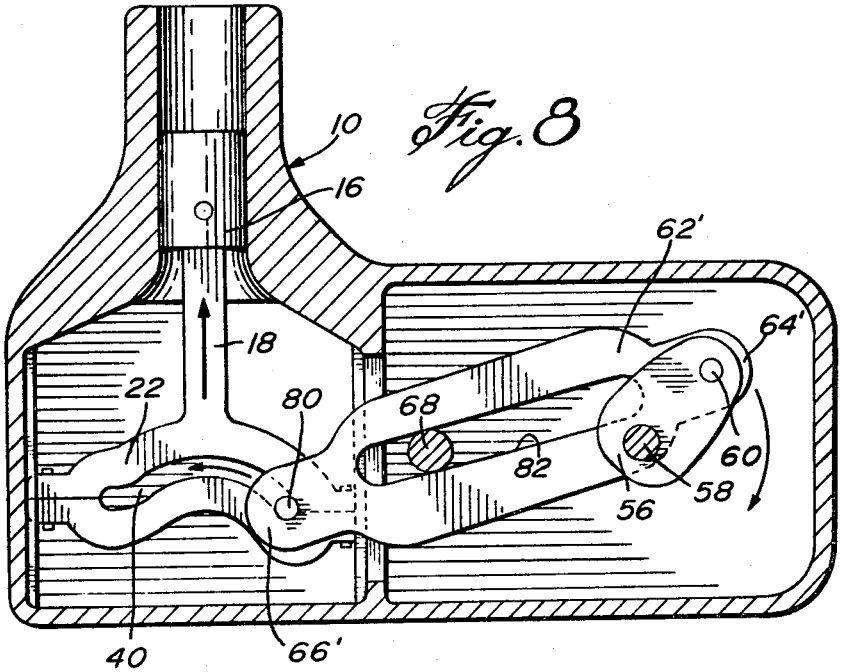
FIG. 8 is a view of another embodiment in which individual crankshafts are not employed.

Referring to FIG. 8, the embodiment illustrated is similar to that illustrated in FIGS. 5 and 6 with the exception, however, that no individual crankshaft is used. The master crankshaft 56 is connected to the connecting rod 18 by means of the slotted lever 62' which has one end 64 engaged at 60 with the master crankshaft and the other end 66' equipped with a pin 80 traversing the slot 40. In this embodiment, the curvature of slot 82 of lever 62' needs not define an eight-shape as in the case of FIGS. 5 and 6; the opposite parallel sides of slot 82 may be straight or define a topological figure which is determined by the particular construction and function of the master crankshaft.

Although the invention has been described in relation to specific forms, it will be evident to the person skilled in the art that it may be refined and modified in various ways. For example, the connecting rods and levers may be fitted with bearings and lubricating devices to minimize wear. Similarly, the pivot pin can be fitted with bearings at its contact points with the levers. It is therefore wished to have it understood that this invention should not be limited in interpretation except by the terms of the following claims.

The embodiments of the invention in which an exclusive property or privilege is claimed are defined as follows:

1. In an internal combustion engine:

a block;

a series of pistons reciprocally displaceable in said block along respective axes;

a connecting rod for each piston, each said rod having one end attached to an associated piston and the opposite end having an enlarged portion defining a track therein; said track extending laterally of the displacement axis of said piston;

a plurality of individual crankshafts rotatably mounted in said block, each crankshaft having throw means cooperatingly engaging an associated track and being displaceable therein; each said track having a shape including a curved portion which causes reduction of loss of power into the respective crankshafts on said connecting rod for a given travel distance of the crankshaft element in the track;

a master crankshaft;

a series of single levers connecting the throw means of individual crankshafts to said master crankshaft and having a slot;

a plurality of pivot means for each lever, each said pivot means being mounted to said block and located between said master crankshaft and its associated individual crankshaft, each said pivot means biasing the operation of its associated lever.

2. In an internal combustion engine:

a block;

a piston reciprocally displaceable in said block along an axis;

a connecting rod having one end attached to said piston; the opposite end of said connecting rod having an enlarged portion defining a track therein; said track extending laterally of the displacement axis of said piston;

crankshaft rotatably mounted in said block and having throw means cooperatingly engaging said track and being displaceable therein;

a master crankshaft;

a single lever connecting said master crankshaft to said crankshaft throw means and having a slot;

pivot means fixedly mounted in said block between said master crankshaft and said crankshaft and extending through the slot of said lever; said pivot means biasing the operation of said lever;

said track having a shape including a curved portion which causes reduction of loss of power into the crankshaft on said connecting rod for a given travel distance of the crankshaft in the track.

3. In an internal combustion engine as defined in claim 2 wherein said track is so shaped that said crankshaft are at the center of said track when said piston is in its uppermost and lowermost travel positions and at opposite lateral extremities of said track when said piston is an intermediate position to said uppermost and lowermost positions.

4. In an internal combustion engine as defined in claim 2 further comprising guide means in said block for guiding displacement of said enlarged portion of said connecting rod relative to said block.

5. In an internal combustion engine as defined in claim 2 wherein the shape of said track in the central region thereof defines an arc which corresponds to displacement of said crankshaft when said piston is in its uppermost region thereby nullifying a vertical effect produced by said crankshaft on said piston in said central region; said shape allowing reciprocal movement displacement of said connecting rod to be maintained in the displacement axis of said piston.

* * * * *